US008012294B2

(12) United States Patent
Austermeier

(10) Patent No.: US 8,012,294 B2
(45) Date of Patent: Sep. 6, 2011

(54) METHOD FOR THE SERIAL APPLICATION OF LABELS ON A TAPE

(75) Inventor: Georg Austermeier, Hovelhof (DE)

(73) Assignee: Multivac Marking & Inspection GmbH & Co. KG (DE)

( * ) Notice: Subject to any disclaimer, the term of this patent is extended or adjusted under 35 U.S.C. 154(b) by 316 days.

(21) Appl. No.: 12/403,049

(22) Filed: Mar. 12, 2009

(65) Prior Publication Data

US 2009/0266484 A1 Oct. 29, 2009

(30) Foreign Application Priority Data

Apr. 25, 2008 (DE) ..... 10 2008 020 736

(51) Int. Cl.

| | |
|---|---|
| ***B29C 65/48*** | (2006.01) |
| ***B32B 37/26*** | (2006.01) |
| ***B32B 38/18*** | (2006.01) |
| ***B65B 61/20*** | (2006.01) |
| ***B65B 41/10*** | (2006.01) |
| ***B65B 41/12*** | (2006.01) |

(52) U.S. Cl. ..... 156/249; 156/289; 156/DIG. 19; 156/DIG. 20; 156/DIG. 37; 53/415; 53/389.2

(58) Field of Classification Search ..... 156/69, 156/160, 163, 164, 249, 250, 277, 289, 361, 156/384, 494, 510, 537, 538, DIG. 19, DIG. 20, 156/DIG. 25, DIG. 37; 53/410, 411, 415, 53/467, 51, 202, 389.1, 389.2, 389.3
See application file for complete search history.

(56) References Cited

U.S. PATENT DOCUMENTS

| | | | | |
|---|---|---|---|---|
| 3,834,642 | A * | 9/1974 | Kampf | 242/413.1 |
| 3,985,983 | A * | 10/1976 | Di Veto | 200/61.18 |
| 4,033,092 | A * | 7/1977 | Vetter | 53/77 |
| 4,417,516 | A * | 11/1983 | Fischer | 101/181 |
| 4,804,979 | A * | 2/1989 | Kamas et al. | 347/116 |
| 4,945,293 | A * | 7/1990 | Wittkopf et al. | 318/7 |
| 4,999,973 | A * | 3/1991 | O'Brien | 53/411 |

(Continued)

FOREIGN PATENT DOCUMENTS

DE 24 37 128 A1 2/1976

(Continued)

OTHER PUBLICATIONS

English Abstract of JP 2006-182496 (2011).*

(Continued)

*Primary Examiner* — Philip Tucker
*Assistant Examiner* — Sing P Chan
(74) *Attorney, Agent, or Firm* — Brooks Kushman P.C.

(57) ABSTRACT

A method for applying labels in rows on a tape, which can be driven by a tape driving mechanism, for which the labels are deposited in consecutive rows at an applicator, disposed stationary at the tape, on the tape, the tape being advanced partially after or during the deposition of a row of labels by a length section at the applicator in that, by a movable tension, a pull loop is pulled out of the path of the tape downstream from the applicator, while the section of tape, located upstream from the pull loop, is kept stationary, and the tension can be moved stepwise between a starting position and an end position and that, during the partial advance, a step is traveled by the tension roller, the length of which is adjusted by a control mechanism.

6 Claims, 3 Drawing Sheets

U.S. PATENT DOCUMENTS

| | | | | | |
|---|---|---|---|---|---|
| 5,160,098 | A | * | 11/1992 | Durkos | 242/413.2 |
| 5,170,611 | A | * | 12/1992 | Buchko et al. | 53/453 |
| 5,256,232 | A | * | 10/1993 | Fuss et al. | 156/187 |
| 5,260,716 | A | * | 11/1993 | Maslanka | 347/214 |
| 5,421,534 | A | * | 6/1995 | Arnold et al. | 242/419.5 |
| 5,466,326 | A | * | 11/1995 | Cherney | 156/359 |
| 5,520,762 | A | * | 5/1996 | Rasmussen et al. | 156/216 |
| 5,603,466 | A | * | 2/1997 | Alexander, III | 242/413.5 |
| 5,659,229 | A | * | 8/1997 | Rajala | 318/6 |
| 5,853,519 | A | * | 12/1998 | Watanabe et al. | 156/247 |
| 6,053,107 | A | * | 4/2000 | Hertel et al. | 101/490 |
| 6,223,799 | B1 | * | 5/2001 | Johnstone | 156/542 |
| 6,314,333 | B1 | * | 11/2001 | Rajala et al. | 700/122 |
| 6,433,499 | B1 | * | 8/2002 | Cote et al. | 318/432 |
| 6,573,923 | B2 | * | 6/2003 | Hevenor et al. | 347/215 |
| 6,843,038 | B1 | | 1/2005 | Haws | |
| 6,856,850 | B2 | * | 2/2005 | Rajala et al. | 700/122 |
| 6,874,723 | B2 | * | 4/2005 | Ueyama et al. | 242/530.3 |
| 2002/0063541 | A1 | * | 5/2002 | Cote et al. | 318/432 |
| 2003/0052148 | A1 | * | 3/2003 | Rajala et al. | 226/44 |
| 2006/0185551 | A1 | * | 8/2006 | Mehlis et al. | 101/484 |
| 2008/0230975 | A1 | * | 9/2008 | Matsuzuki et al. | 270/52.08 |
| 2009/0072974 | A1 | * | 3/2009 | Miyashita et al. | 340/572.1 |

FOREIGN PATENT DOCUMENTS

| | | | | |
|---|---|---|---|---|
| GB | 2 253 385 | A | | 3/2010 |
| JP | 61095708 | A | * | 5/1986 |
| JP | 08113865 | A | * | 5/1996 |
| JP | 10072022 | A | * | 3/1998 |
| JP | 2006182496 | A | * | 7/2006 |

OTHER PUBLICATIONS

Englsih Abstract of JP 61-095708 (2011).*
English Abstract of JP 10-072022 (2011).*
Englsih Abstract of JP 08-113865 (2011).*
German Office Action Dated Dec. 10, 2008, Application No. 10 2008 020 736.5-27—Applicant MR Etikettiertechnik GmbH & Co. KG, 3 Pages.
DE2437128—English Language Machine Translation, http://epo.worldlingo.com/wl/epo/epo.html?ACTION=description-retrieval&OPS=ops.epo, Dated Mar. 11, 2010, 3 Pages.

* cited by examiner

METHOD FOR THE SERIAL APPLICATION OF LABELS ON A TAPE

BACKGROUND OF THE INVENTION

The present invention relates to a method for the serial application of labels on a tape.

Such a tape may, for example, be a packaging film, on which consecutive rows of labels are deposited. The film with the labels may subsequently be used for sealing packages.

For applying the labels, the tape initially is passed along an applicator, which deposits the labels serially on the tape. After or already during the deposition of a row, the tape is shifted by a length section, in order to make available a free section of tape for depositing a subsequent row. This step of advancing the tape by a length section after or during the deposition of a row of labels will be referred to in the following as a partial advance.

For the previously customary labelers, this partial advance takes place in that a pull loop downstream from the applicator is pulled by means of a tension roller out of the traveling path of the tape, while the section of the tape upstream from the pull loop is kept stationary. This means that the partial advance at the applicator takes place with the tape drive at rest, while the tension roller moves independently of the tape drive.

In a conventional mode of operation, initially a set of label rows is completed with the tape driving mechanism at rest in that the applicator deposits several rows one behind the other on the tape, which is moved further here in several partial advances. Subsequently, with the help of the tape driving mechanism, a section of the film, comprising a corresponding set of labels, is deposited on the packages. For example, the advance of the package lanes can be used as a tape driving mechanism, through the pulling action of which the tape is moved a segment of its length further.

For conventional labelers, the tension roller for forming the pull loop is moved pneumatically between two stops, which limit the travel of the tension roller. For example, while the tape driving mechanism is stationary, such a tension roller is pulled pneumatically against an upper stop and can later on fall back once again into its initial position. This type of loop formation has several disadvantages. At high operating speeds, the labels are not always positioned with sufficient accuracy, since the stops of the tension roller cannot always be set with a sufficient accuracy. The reproducibility of the positioning of the labels also suffers from this. The quietness of the running of the labeler is affected adversely and the overall height is increased. Finally, the running times of the pneumatic cylinder may fluctuate, for example, due to the effect of temperature and of pressure fluctuations in the system.

The preparation of a set with a large number of rows of labels is a particular problem, since a partial advance must be brought about for each row with the help of a separate loop. This means that there must be a tension roller for each row. For a large number of rows per set, the construction expense is hardly justifiable anymore and a change in the mode of operation of the machine leads to an appreciable expense for retrofitting. In particular, this system is relatively inflexible, expensive and error prone.

SUMMARY OF THE INVENTION

It is therefore an object of the present invention to provide a method for the application of labels in rows on a tape, this method enabling the labels to be positioned accurately and reproducibly on the tape with relatively little expense, while avoiding the aforementioned problems. In particular, this method should also make it possible to apply a larger number of rows of labels for subsequently transferring them to article lanes with little expense.

A further object is to create a labeler for carrying out such a method.

According to the invention, these objectives are accomplished by a method of claim 1.

For the inventive method, the tension roller is moved between an initial position and a final position. During the partial advance before or during the depositing of a row of labels, the tension roller carries out a driving step, the length of which is set by a control mechanism.

With that, the tension roller can be moved over a longer path between the initial position and the final position. This path can be divided into individual driving steps. Any point along the whole of the path can be approached with the help of the control mechanism. The magnitude of a driving step can be selected so that an advance of a length section of the tape at the applicator is produced, which is necessary in order to maintain the distance between the rows of labels.

With that, several pneumatic tension rollers, operating independently of one another, are no longer necessary to carry out several partial advances. Instead, these can be replaced by a single tension roller of the present invention, which carries out individual driving steps consecutively for pulling out the pull loop further. This way of operating represents an appreciable simplification of the method.

For example, the tension roller can be driven by a stepper motor control mechanism, for which the length of a driving step can be programmed. This represents an appreciable advance over the present situation, in which, for setting the partial advance, the stops of the pneumatic tension roller had to be changed manually. However, the use of a servo motor, which carries out the driving steps of the tension roller, is also conceivable. On the whole, the construction is simplified considerably by the use of a single tension roller, which can be moved readily even in a horizontal plane, so that the overall height of the labeler is not increased.

The rows of labels can be positioned appreciably more accurately and this position can be reproduced better than in the case of the previously used pneumatic driving mechanism of the tension roller. Various further disadvantages of a pneumatic driving mechanism, such as a fluctuating cylinder running times, are avoided by using a stepper motor control.

Preferably, the length of the driving step in the partial advance correspondence to a fraction of the path of the tension roller between the starting position and the end position.

Furthermore, preferably, the tension roller can be moved in partial steps of a defined length and the length of the driving steps in the partial advance represents the sum of a number of partial steps, which is predetermined by the control mechanism.

This means that, when the tension roller is moved, a driving step can be formed from the sum of the partial steps of very small length. The length of the partial steps can be selected to be so small, that an exact positioning of the tension roller remains possible. For example, for moving the tension roller, a stepper motor can be used, which can carry out partial steps of the same length. For forming a driving step, the control mechanism of the stepper motor specifies a number of partial steps, which are to be carried out in a driving step.

In a preferred embodiment of the inventive method, a set of consecutive rows of labels is completed on the tape in a set-producing step and, after each set-producing step, the tape is shifted by means of the tape driving mechanism downstream from the pull loop by one length, which corresponds to the sum of the partial advances of the tape, covered at the applicator in the set-producing step.

Preferably, the tape is a pre-packaging film and, during the advance of the tape by the tape driving mechanism after the set-producing step, a set of label letters is applied on articles such as packages or the like.

Preferably, after the set-producing step, the tension roller is moved synchronously with the tape driving mechanism back into its starting position.

BRIEF DESCRIPTION OF THE DRAWINGS

A preferred example of the invention is explained in greater detail in the following by means of the drawing, in which.

DETAILED DESCRIPTION

Figure 1:
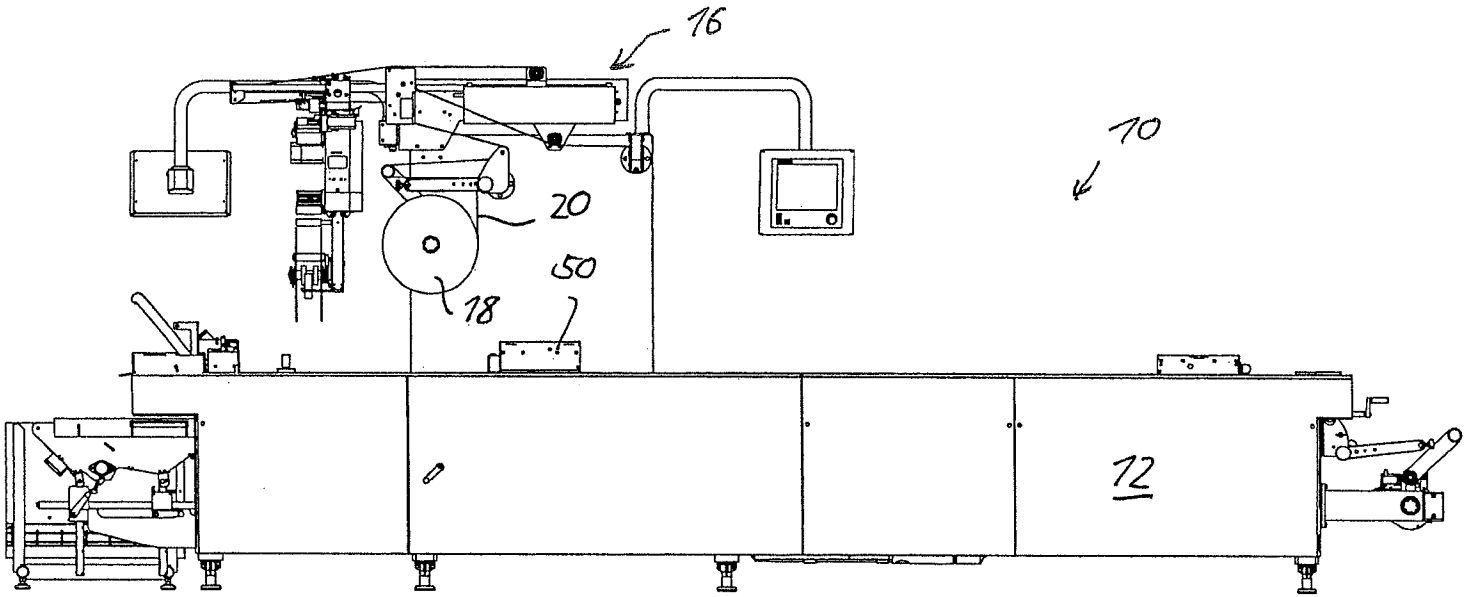
FIG. 1 shows a side view of a labeler for carrying out the inventive method.
Figure 2:
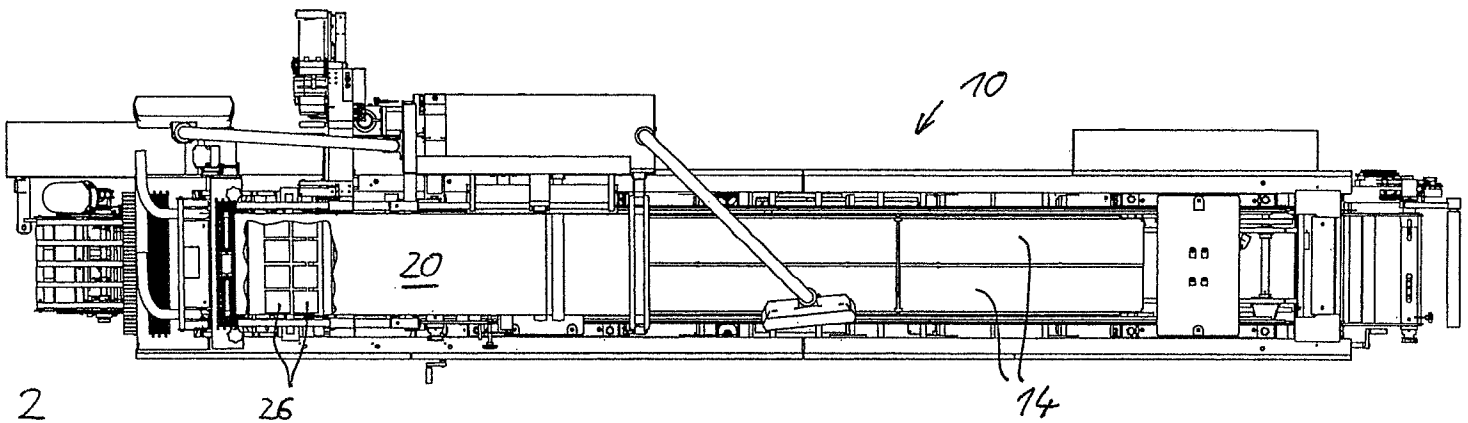
FIG. 2 shows a plan view of the labeler of FIG. 1.

The labeler 10, shown in FIG. 1, comprises a machine frame 12, in which lanes of articles, such as packages or the like, are guided. These lanes 14 can be recognized in plan view in FIG. 2. A tape-shaped packaging film, which previously was provided with labels arranged in rows, is applied on the articles. At a machine region 16, disposed above the lanes 14, the labeler 10 therefore comprises a supply roll 18, from which the film tape 20 is unwound and is supplied downward over an arrangement of rollers to the lanes 14 of articles. As it is traveling over the arrangement of rollers, the tape 20 is provided with rows of labels 26.

Rows of labels are applied on the tape 20 by an applicator 24, which is disposed at the tape. This applicator 24 may, for example, comprise a conveyor belt 60 (FIG. 4), which is stretched transversely over the tape 20 and on which the labels are dispensed initially and guided in a row over the tape 20. A suitable applicator then presses the labels onto the surface of the tape 20, so that they can be pulled off by a movement of the tape 20 in its running direction and a new row of labels can be made available one again from the conveyor belt 60 of the applicator 24. The construction of the applicator 24 is known from the prior art and is not a subject matter of the present invention.

Figure 3:
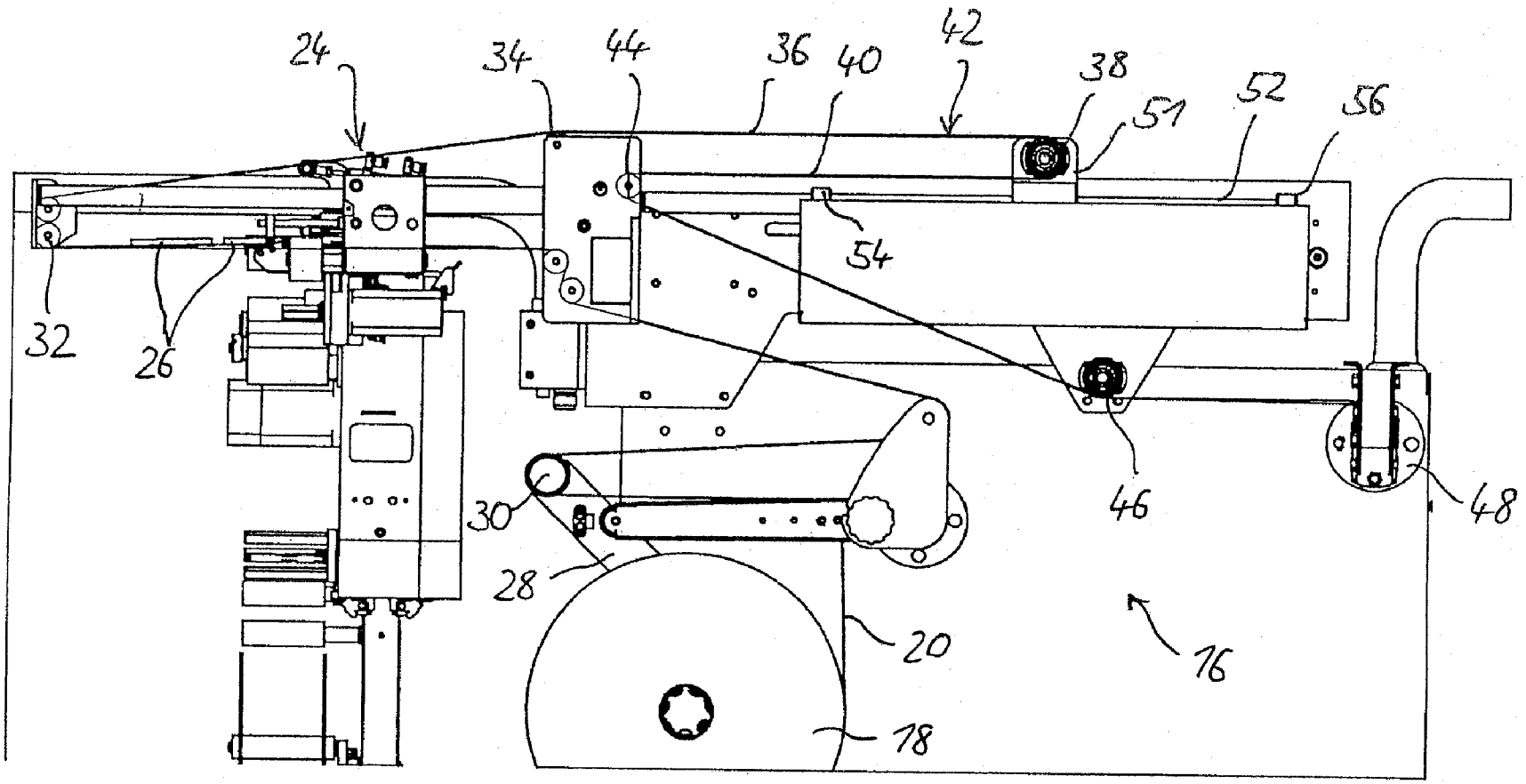
FIG. 3 shows a side view of a portion of the labeler of FIG. 1.
Figure 4:
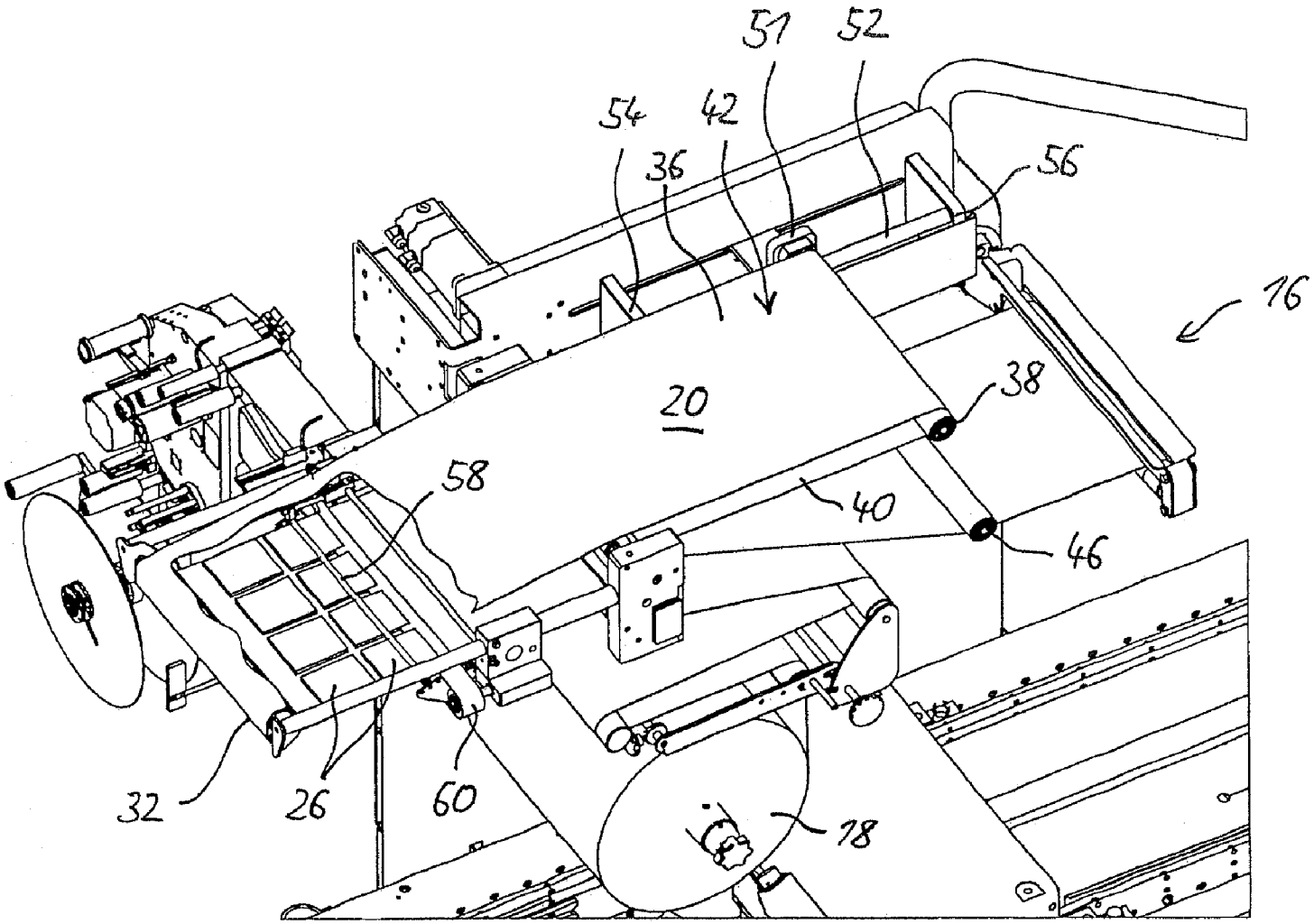
FIG. 4 shows a perspective view of the part of the inventive labeler, shown in FIG. 3.

In FIGS. 3 and 4, the applicator 24 can be recognized in further views. Aside from the conveyor belt, it comprises a bracket 58, which can be pressed down against the surface of the tape 20 and presses down a section of the labels of the row on the conveyor belt 60 to be transferred onto the tape 20, namely the section which protrudes from the conveyor belt 60 in the running direction of the tape 20. Two rows of labels 26 can be recognized in FIGS. 3 and 4.

Upstream from the applicator 24, the roll arrangement comprises a guide roller 30, which can be swiveled at an arm 28. The guide roller 30 can be swiveled about the swiveling axis of the arm 28, which is offset parallel to its own axis of rotation. Since the arm 28 is freely movable, tension can be exerted hereby, downstream from the pivotable guide roller 30, on the tape 20. This tension is not transferred to the supply roll 18 and a torque for unwinding the supply on the tape 20 is not exerted on said roll 18. Accordingly, synchronization is not required between the unwinding of the tape supply at the supply roll 18 and the further devices for transporting tape, which are still to be described in greater in the following. The tape 20 is therefore pretensioned only by the weight of the pivotable guide roller 30, so that it can be transported uniformly by the applicator 24.

Downstream from the applicator 24, the tape 20, which is provided with the rows 26 of labels, is deflected by approximately 180° over a pair of guide rollers 32, runs over a further upper guide roller 34 and, downstream from this upper guide roller 34, into a horizontal section 36 of the tape. This is diverted over a tension roller 38 to an also horizontal section 40 of the tape, so that the two tape sections 36 and 40 are parallel to one another. The tape sections 36 and 40 form a pull loop 42, together with the part of the tape 20, resting directly on the tension roller 38. By means of a further guide roller 44, the lower, horizontal tape section 40, running in the direction of the applicator 24, is diverted downward at angle and reaches the article lanes 14 over further rollers 46, 48. The tape 20 is applied by a further application device 50, which is shown diagrammatically only in FIG. 1 and is disposed directly above the lanes 14.

If the article lanes 14 are moved forward, a tension is exerted therewith automatically on the tape 20 in the direction of the article lanes 14. With that, the transporting device for the article lanes 14 simultaneously forms a driving mechanism for the tape 20 of the packaging film. Alternatively, it is possible to provide a separate driving mechanism for the tape 20. This would have to be synchronized with the movement of the article lanes 14 in such a manner, that a uniform application of the packaging film on the articles becomes possible.

The tension roller 38 is seated freely rotatably on a horizontal axis, the end of which, facing away from the viewer in FIG. 3, is fastened at a carriage 51, which is able to move on a horizontal rail 52. On the carriage 51, the tension roller 38 is able to move between a stop 54 of the rail 52 facing the applicator 24 and an opposite stop 56. During this movement, the carriage 51 is driven by a stepper motor, the details of which are not shown, so that the tension roller 38 can be moved stepwise along the rail 52. Between a starting position of the tension roller 38, in which the carriage 51 is up against the left stop 54 in FIG. 3, and the end position at the opposite stop 56, any position of the tension roller 38 along the path, on which it travels, can be set with the help of the stepping motor. For this purpose, the path is divided into small partial steps. A step in the travel between an actual position and a nominal position of the tension roller 38 is formed by a specified number of such partial steps.

The length of the horizontal pull loop 42 can be changed by the movable tension roller 38. The pull loop 42 has its shortest length when the tension roller 38 is in the starting position at the left stop 54. The length increases during the movement of the tension roller 38 in the direction of the end position at the right stop 56. Accordingly, during the movement of the tension roller 38, the pull loop 42 is pulled out of the current path of the tape 20 downstream from the applicator 24.

For moving the tension roller 38, the carriage 51 is driven independently of the tape 20, with which, however, it can be synchronized. For example, the stepper motor for driving the carriage 51 of the tension roller 38 can be synchronized suitably with the driving mechanism for advancing the article lanes 14.

The mode of functioning of the labeler 10, shown here, is described in the following.

The starting point here is a situation, in which the bracket 58 of the applicator 24 is pressed down and the labels 26, protruding from the conveyor belt 60 in the running direction of the tape 20, are pressed down onto the surface of the tape 20, as shown in FIGS. 3 and 4. After this row of labels is deposited or also already during the deposition, the tape 20 is advanced partially at the applicator 24 by a length section, which corresponds to the distance between two rows of labels 26, so that sufficient space is made available on the tape 20 behind the row of labels 26 already deposited for depositing a further row of labels, which is brought along from a dispensing edge by the conveyor belt 60 in a manner, the details of which are not given here.

This partial advance of the tape 20 during or after the deposition of a row of labels 26 takes place with the help of the tension roller 38 while the tape driving mechanism is at rest. To achieve the partial advance, the tension roller 38 is moved one step here, the length of which is set by a stepper motor control. Because the tape driving mechanism is at rest here and, accordingly, the tape section, upstream from the pull loop 42, is kept stationary, the section of the tape, upstream from the tension roller 38, is pulled in the direction of the tension roller 38 by a movement of the tension roller 38 in the direction of its end stop 56, so that the desired partial advance by a length section, corresponding to the distance between the rows of labels 26, takes place at the applicator 24.

The magnitude of the step, for achieving the desired partial advance by one length section at the applicator 24, depends on the geometry of the pull loop 42, the direction of movement of the tension roller 38, etc. For the arrangement shown here, a movement of the tension roller 38 by one step in the direction of its final stop 56, which is equal in magnitude to the length section advance, which is to be achieved at the applicator 24, is sufficient. However, other arrangements of the tension roller 38 are also conceivable, for which this tension roller 38 moves in a direction perpendicular to the running direction of the tape 20, into the latter and, in this way, produces the pull loop. The two sections 36, 40 of the pull loop 42 need also not necessarily run parallel to one another; instead, they may enclose a different angle with one another.

Once the partial advance at the applicator 24 has taken place, the process of depositing a row of labels 26 can be repeated and a further partial advance takes place, during which the tension roller 38 carries out a further step, as described above. Accordingly, the complete path of the tension roller 38 between its starting position and its end position can be divided into a number of steps, corresponding to a number of rows of labels 26, which are to be applied consecutively. This means that, by a stepwise elongation of the pull loop 42, a number of consecutive partial advances can be produced at the applicator 24 while the tape driving mechanism is at rest. For this purpose, it is not necessary to have a number of pull loops corresponding to the number of rows of labels 26, as it is in the prior art; instead, a single pull loop 42, which in each case is extended by a certain amount, as shown in FIGS. 3 and 4, is sufficient.

The operation of the stepper motor for driving the carriage 51 of the tension roller 38 must be coordinated here with the operation of the applicator 24. The length of a step of the tension roller 38 is set here as a function of the desired distance between rows of labels 26 in that the stepper motor control mechanism determines a number of partial steps, the sum of which represents the length of the step in the partial advance. This can be achieved by a simple programming of the stepper motor control mechanism. The control by a stepper motor here is appreciably less problematic than the known, pneumatic movement of the tension roller 38 between two fixed stops, for which intermediate steps are not possible. Furthermore, due to the stepper motor control, defined positions of the tension roller 38 can be achieved with a high degree of accuracy. However, the present invention is not limited to the use of a stepper motor with an appropriate stepper motor control mechanism; instead, other driving mechanisms, such as a servo motor can be used instead, which moves the carriage 51 with the tension roller 38 and carries out the steps. The step need then not necessarily be divided into increments, that is, into small partial steps of defined length.

To begin with, a complete set of consecutive rows of labels 26, which comprises a desired number of rows, can be completed on the tape 20. During the deposition of a row of labels 26, a partial advance is carried out in the manner described above by moving the tension roller 38 by a step in the direction of its end stop 56. For example, the tension roller 38, on its way from the starting position to the end position, can carry out a number of steps, which corresponds to the number of partial advances or to the number of rows of labels 26 of the set, which are to be applied. The tape driving mechanism is at rest during the construction of this set of rows of labels 26, so that the section of tape, upstream from the pull loop 42, can be kept stationary.

If the set of rows of labels 26 is completed, the tape driving mechanism is activated, so that the tape 20, downstream from the pull loop 42, is advanced by a length, which represents the sum of the partial advances of the tape 20 at the applicator 24, traveled in the set-producing step. The packing film of the tape 20 can be transferred to the article lanes 14 here. For this mode of operation, a corresponding set of rows of labels 26 is applied on the articles downstream from the pull loop 42 after a set of rows of labels 26 has been produced upstream from the pull loop 42.

After the set-producing step, the tension roller 38 is moved back once again to its starting position at the stop 54 facing the applicator 24. This moving back may take place synchronously with driving the tape.

During this construction of the set of rows of labels 26 in the set-producing step, the tape is advanced intermittently at the applicator 24 by the tension roller 38, that is, the steps of the tension roller 38 take place intermittently. However, an operation is also conceivable, for which the tape 20 is pulled continuously along the applicator 24 by the tension roller 38 during the set-producing step and the steps adjoin one another without interrupting the running of the tape. The applicator 24 is to be constructed here in an appropriate manner, for example, in that a conveyor belt 60, running transversely to the running direction of the tape 20, is not made available to a row of labels 26; instead, dispensing is from a dispensing tape, which runs essentially in the same direction as tape 20. Such application devices are also known from the prior art.

The positions of the tape 20 and the labels 26 relative to one another can be controlled with appreciably greater accuracy by a stepper motor control system than when a pneumatically driven tension roller 38 is used. Moreover, the arrangement introduced here for enlarging the pull loop 42 step-by-step can be adapted appreciably more flexibly to the desired circumstances, such as the number of rows of labels 26, which are to be dispensed in one set-producing step on the article lanes 14. For this purpose, it may not be necessary to retrofit the labeler 10; only stepper motor for driving the tension roller 38 would have to be reprogrammed.

What is claimed is:

1. A method for applying labels in rows on a tape, which is adapted to be driven by a tape driving mechanism, comprising the steps of:

depositing the labels on the tape in consecutive rows at an applicator, disposed stationary at the tape, partially advancing the tape after or during the deposition of a row of labels by a length section at the applicator by a movable tension roller, such that a pull loop is pulled out of a path of the tape downstream from the applicator, while a section of the tape, located upstream from the pull loop, is kept stationary, and moving the tension roller stepwise between a starting position and an end position, such that during the partial advance, a step is traveled by the tension roller, the length of which is adjusted by a control mechanism.

2. The method of claim 1, wherein the length of the step in the partial advance corresponds to a fraction of the path of the tension roller between the starting position and the end position.

3. The method of claim 1, wherein said step of moving includes the step of moving the tension roller in partial steps of defined length and such that the length of the steps during the partial advance represent a sum of a number of partial steps specified by the control mechanism.

4. The method of claim 1, further comprising the steps of:

completing a set of consecutive label rows on the tape in a set-producing step, and after each set-producing step, advancing the tape downstream from the pull loop by the tape driving mechanism by one length, which corresponds to the sum of the partial advances of the tape at the applicator, traveled in the set-producing step.

5. The method of claim 4, wherein the tape is a packaging film and further comprising the step of, during the advance of the tape by the tape driving mechanism after the set-producing step, applying a section of tape with a set of label rows on articles.

6. The method of claim 4, further comprising the step of, after the set-producing step, moving the tension roller back once again into its starting position synchronously with the tape-driving step.

* * * * *